US006485579B1

(12) United States Patent
Nillius et al.

(10) Patent No.: US 6,485,579 B1
(45) Date of Patent: Nov. 26, 2002

(54) PROCESS FOR PREPARATION OF SOFT MAGNETIC COMPOSITES AND THE COMPOSITES PREPARED

(75) Inventors: Magdalena Nillius, Sundborn (SE); Patricia Jansson, Viken (SE)

(73) Assignee: Höganäs AB, Höganäs (SE)

( * ) Notice: Subject to any disclaimer, the term of this patent is extended or adjusted under 35 U.S.C. 154(b) by 0 days.

(21) Appl. No.: 09/484,271

(22) Filed: Jan. 18, 2000

Related U.S. Application Data

(63) Continuation of application No. PCT/SE98/01389, filed on Jul. 16, 1998.

(30) Foreign Application Priority Data

Jul. 18, 1997 (SE) ..... 9702744

(51) Int. Cl.[7] ..... H01F 1/03
(52) U.S. Cl. ..... 148/104; 148/122; 419/66
(58) Field of Search ..... 148/104, 122; 419/61, 64, 66

(56) References Cited

U.S. PATENT DOCUMENTS 4,602,957 A 7/1986 Pollock et al.
5,798,177 A 8/1998 Jansson
6,149,704 A * 11/2000 Moro et al. ..... 75/230

FOREIGN PATENT DOCUMENTS

| | | | |
|---|---|---|---|
| DE | 3439397 | C2 * | 1/1990 |
| EP | 0179557 | | 4/1986 |
| JP | 51-43007 | | 11/1976 |
| JP | 57114637 | A | 7/1982 |
| SU | 425737 | A | 3/1975 |
| WO | WO95/29490 | | 11/1995 |

* cited by examiner

*Primary Examiner*—John Sheehan
(74) *Attorney, Agent, or Firm*—Burns, Doane, Swecker & Mathis, LLP

(57) ABSTRACT

The invention concerns a process for the preparation of soft magnetic composite products comprising the steps of providing particles of an iron based soft magnetic material with an electrically insulating layer; optionally mixing the dry powder with a lubricant; compacting the powder and heating the obtained component at an elevated temperature in the presence of water vapour. The invention also comprises the iron powder compact subjected to this treatment.

14 Claims, 1 Drawing Sheet

PROCESS FOR PREPARATION OF SOFT MAGNETIC COMPOSITES AND THE COMPOSITES PREPARED

This application is a continuation of International Application No. PCT/SE98/01389, filed Jul. 16, 1998 that designates the United States of America and which claims priority from Swedish Application No. 9702744-5, filed Jul. 18, 1997.

FILE OF THE INVENTION

This invention relates to soft magnetic composites. More particularly, the invention relates to soft magnetic composites having improved strength. These composites which combine good soft magnetic properties with high strength are particularly useful as components in electrical machines.

BACKGROUND OF THE INVENTION

Currently used components of soft magnetic composites prepared from pressure compacted coated iron powder have a relatively low compressive strength. This is due to the fact that these materials cannot be subjected to the usual method of improving the strength, i.e. sintering, since the high temperature required for sintering damages the insulating coating around the powder particles. Today soft magnetic composites are heat treated at a temperature below the sintering temperature in order to improve the magnetic characteristics. Also, the compressive strength of the component can be somewhat improved by such a heat treatment. WO95/29490 discloses a method of making a component having improved magnetic properties by compacting or die-pressing a powder composition of insulated particles of an atomised or sponge iron powder optionally in combination with a lubricant and in some cases a binder and subsequently subjecting the compacted composition to heat treatment in air at a temperature preferably not more than 50–500° C. The strength of components prepared according to this patent is in the range 50–100 MPa, the higher strength being achieved at the cost of poorer magnetic properties. This strength is comparatively low and insufficient for certain applications.

Japanese Patent Publication 51-43007 discloses a method of manufacturing iron-based machine parts whereby an iron powder is pressure-compacted to obtain a green compact and the green compact is heated under an oxidising atmosphere including vapour at 400–700° C. The purpose of this known method is to form iron oxide onto the surface of each iron grain. This procedure replaces the two steps involving dewaxing, i.e. the removal of lubricant, which usually is carried out at a temperature of at least 400° C., and sintering, which is carried out at a temperature of at least 1100° C. to form bonds between the metal particles. The Japanese publication also teaches that sizing of the body can be avoided because of the fact that the compacted and heat treated parts have high dimensional accuracy. The Japanese publication does not concern magnetic materials.

It has now been found that if uncoated iron powder particles, i.e. iron particles which are not provided with an insulating layer, are compacted and subsequently treated with vapour the strength of the material will increase but the energy loss in the material will be unacceptably large. When it comes to the coated iron powder particles used for magnetic applications it was found that the energy loss in coated material increases with increasing frequency and this tendency is even larger for vapour treated material than for coated material heated in air. During extensive studies it was however found that for frequencies less than 1000, preferably less than 300 Hz, it is possible to prepare soft magnetic composites having improved strength and a low energy loss.

SUMMARY OF THE INVENTION

The invention provides a process for the preparation of soft magnetic composites comprising the following steps: a) providing a low carbon powder of a soft magnetic material selected from the group consisting of an atomized or sponge powder of essentially pure iron or an iron-based prealloyed powder containing Si, Ni, Al or Co, b) providing the particles of the powder with an electrically insulating layer, c) compacting the powder to a composite body, and d) heating the composite body at a temperature between 400 to 700° C. in the presence of vapor.

The invention also provides a composite body of compacted electrically insulated particles of a soft magnetic material, the compacted body having been heat treated in the presence of water vapour. The compacted body is useful in AC applications below 1000 Hz and preferably below 300 Hz.

DETAILED DESCRIPTION OF THE INVENTION

Figure 1:
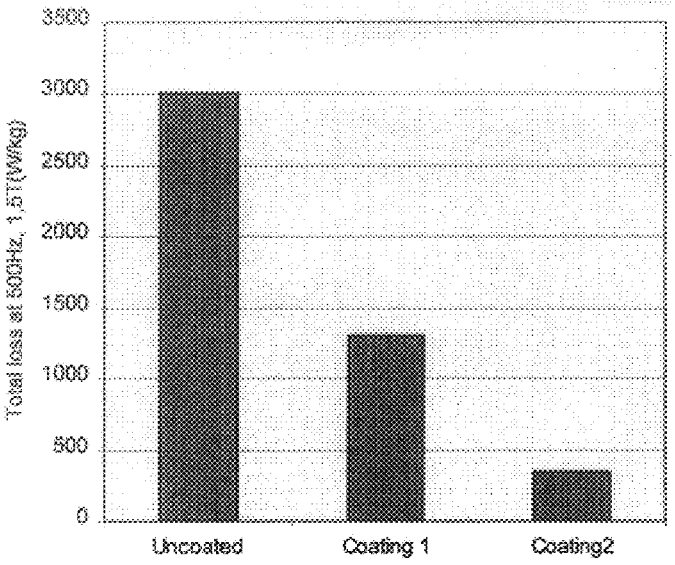
FIG. 1 is a graph of total loss at 500 Hz, 1.5 T (W/Kg) for uncoated powder (ABC.100.30), powder with insulated coating 1 (ABM 100.32) and powder with insulated coating 2 (Somaloy™ 500).

The present invention concerns compacted, soft magnetic composites for AC applications which have improved strength in combination with low energy losses and which composites essentially consist of compacted electrically insulated particles of a soft magnetic material. A distinguishing feature of the invention is that the compacted composite material is subjected to vapour treatment.

The soft magnetic material might be any type of known material, such as essentially pure iron powders, e.g. atomised or sponge iron powders or prealloyed iron-based powders containing, e.g. Ni, Si, Al or Co having a low carbon content.

Furthermore, the particles of the soft magnetic material must be coated or provided with an electrically insulating layer to minimise the eddy current loss in the compacted part. The type of insulating coating is not critical as long as metal to metal contact and cold welding between the particles are avoided and the coating is stable during the compaction and subsequent heat treatment. The coating might be based on phosphorous oxides or phosphate, silicon oxide or polymers, such as polyamides. It is preferred that the coating is very thin in order to have as little effect on the density of the compacted part as possible.

A specific example of an atomised iron powder with a suitable insulation is ABM 100.32 available from Höganäs AB, Sweden and disclosed in the publication WO 95/29490, which is hereby incorporated by reference. According to this publication particles of atomised or sponge iron are treated with a phosphoric acid solution to form an iron phosphate layer at the surface of the iron particles. The phosphorous acid treatment is preferably carried out at room temperature and for a period of about 0.5 to about 2 hours and then the powder is dried. A suitable insulated sponge iron powder is SCM 100.28, which is also available from Höganäs AB.

Before compaction the powder of the electrically insulated particles is normally mixed with a lubricant. The compaction could however also be carried out in a lubricated die. A combination of lubricant in the mixture and the use of a lubricated die is also possible. The compaction pressure normally is generally below 1000 MPa and varies preferably between 400 and 800 MPa. The amount of lubricant is normally less than 1% by weight of the powder composition and varies preferably between 0.05 and 0.8% by weight. Various types of conventional lubricants can be used, such as metal soaps, waxes and polyamides.

The temperatures for the vapour treatment usually vary between 400 and 700° C. The preferred temperatures varies between 420 and 580° C. According to a preferred embodiment the compacted composite material is first heated in a furnace with an atmosphere consisting of air. When the desired elevated temperature has been reached the vapour is introduced into the furnace. The vapour treatment is then carried out at atmospheric pressure or slightly above atmospheric pressure. The vapour treatment time should normally be between 5 and 60 minutes, preferably between 10 and 45 minutes.

The invention is further illustrated by the following non limiting examples.

EXAMPLE 1

ABM100.32, an atomised iron powder available from Höganäs AB, Sweden was mixed with 0.5% by weight of the lubricant Kenolube™ and compacted at 800 MPa to magnetic rings (toroid rings with an inner diameter of 45 mm, an outer diameter of 55 mm and a thickness of 5 mm) and TRS-bars (dimensions approximately 30×12×6 mm) used to measure the bending strength.

The sample was vapour treated at 500° C. for 30 minutes. Another sample was treated at 500° C. for 30 minutes in air for comparison. The samples were removed from the furnace and cooled to room temperature. The bending strength after this treatment was 205 N/mm$^2$, and the energy losses measured at different frequencies are listed in table 1.

EXAMPLE 2

Somaloy™ 500 which is available from Höganäs AB, Sweden, and is atomised powder with an insulating layer, was compacted at 800 MPa and then treated in the same way as ABM 100.32 in example 1. The bending strength after this treatment was 130 N/mm$^2$, and the energy losses measured at different frequencies are listed in the following table.

TABLE 1

| Material (heat-treatment) | Bending strength (N/mm$^2$) at density (g/cm$^3$) | Density of toroids (g/cm$^3$) | Loss at 50 Hz 1.5T (W/kg) | Loss at 100 Hz 1.5T (W/kg) | Loss at 200 Hz 1.5T (W/kg) |
|---|---|---|---|---|---|
| ABM 100.32 (vapour 500° C. 30 min) | 205 (7.31) | 7.33 | 30 | 100 | 590 |
| ABM 100.32 (air 500° C. 30 min) | 50 (7.35) | 7.26 | 15 | 30 | 120 |

TABLE 1-continued

| Material (heat-treatment) | Bending strength (N/mm$^2$) at density (g/cm$^3$) | Density of toroids (g/cm$^3$) | Loss at 50 Hz 1.5T (W/kg) | Loss at 100 Hz 1.5T (W/kg) | Loss at 200 Hz 1.5T (W/kg) |
|---|---|---|---|---|---|
| Somaloy ™ 500 (vapour 500° C. 30 min) | 130 (7.35) | 7.33 | 20 | 50 | 180 |
| Somaloy ™ 500 (air 500° C. 30 min) | 45 (7.33) | 7.32 | 15 | 30 | 90 |
| ABC.100.30* (vapour 500° C. 30 min) | 135 (7.36) | 7.36 | 50 | 170 | 1220 |

*Powder without insulation for comparison

The above table illustrates the effect of vapour treatment on components of coated iron powders compared with conventional heat treatment in air and with an uncoated iron powder ABC-100.30 (available from Höganäs AB, Sweden). The difference between the coated powders on one hand and the uncoated powder on the other hand is very clearly demonstrated in FIG. 1, wherein "Uncoated" refers to the powder ABC 100.30, coating 1 refers to the powder ABM 100.32 and coating 2 refers to the powder Somaloy™ 500.

Figure 2:
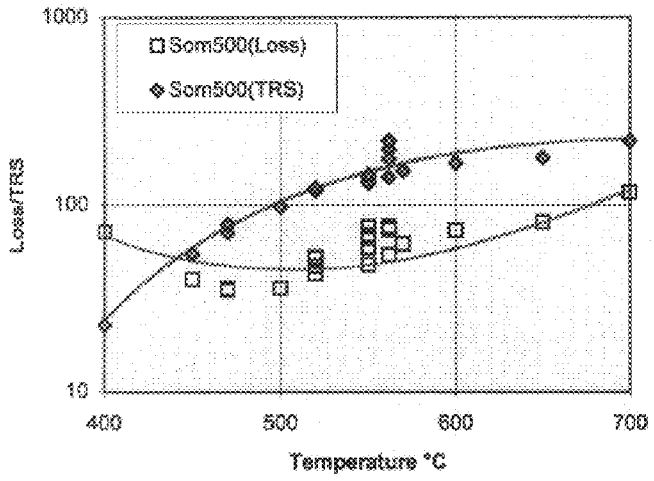
FIG. 2 is a graph of energy losses and transverse rupture strength (TRS) versus heat treatment temperature for Somaloy™500.
Figure 3:
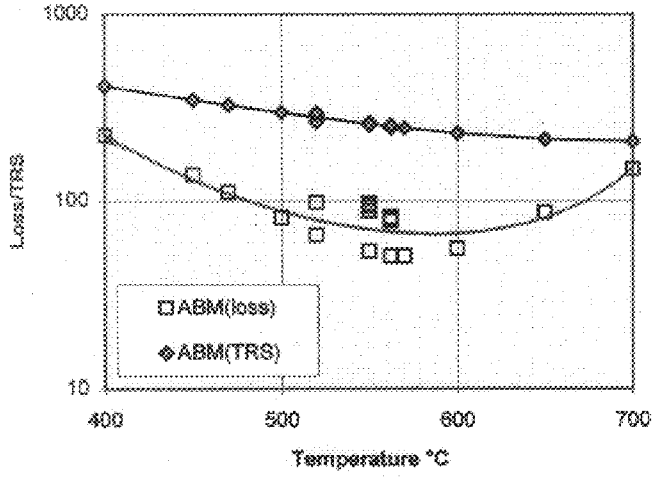
FIG. 3 is a graph of energy losses and TRS versus heat treatment temperature for ABM 100.32.

Additionally, as can be seen from the enclosed FIGS. 2 and 3, the bending strength (TRS) and the losses vary not only with the type of insulation but also with the temperature. The optimum time and temperature is specific to each insulated powder.

What is claimed is:

1. A process for the preparation of soft magnetic composites comprising the followings steps:

a) providing a low carbon powder of a soft magnetic material selected from the group consisting of an atomized or sponge powder of essentially pure iron or an iron-based prealloyed powder containing Si, Ni, Al or Co;

b) providing the particles of the powder with an electrically insulating layer;

c) compacting the powder to a composite body; and d) heating the composite body at a temperature between 400 and 700° C. in the presence of water vapor.

2. The process according to claim 1, wherein the heating is performed in a furnace heated to between 420 and 580° C.

3. The process according to claim 1, wherein the powder is mixed with a lubricant before compaction.

4. The process according to claim 3, wherein the lubricant is selected from the group consisting of metal soaps, waxes or polymers.

5. The process according to claim 3, wherein the lubricant is used in an amount less than 1% by weight of the composition.

6. The process according to claim 1, wherein the compaction is carried out at a pressure between 400 and 1000 MPa.

7. The process according to claim 1, wherein the composite bodies are heated in a furnace atmosphere consisting essentially of air before water vapor is introduced into the furnace.

8. The process according to claim 3, wherein the lubricant is used in an amount between 0.05 and 0.8% by weight of the composition.

9. The process according to claim 2, wherein the composite bodies are heated in a furnace atmosphere consisting essentially of air before water vapor is introduced into the furnace.

10. The process according to claim 3, wherein the composite bodies are heated in a furnace atmosphere consisting essentially of air before water vapor is introduced into the furnace.

11. The process according to claim 4, wherein the composite bodies are heated in a furnace atmosphere consisting essentially of air before water vapor is introduced into the furnace.

12. The process according to claim 5, wherein the composite bodies are heated in a furnace atmosphere consisting essentially of air before water vapor is introduced into the furnace.

13. The process according to claim 6, wherein the composite bodies are heated in a furnace atmosphere consisting essentially of air before water vapor is introduced into the furnace.

14. The process according to claim 10, wherein the composite bodies are heated in a furnace atmosphere consisting essentially of air before water vapor is introduced into the furnace.

* * * * *